United States Patent [19]

Tanaka et al.

[11] 4,231,007

[45] Oct. 28, 1980

[54] HIGH VOLTAGE SWITCH FOR COOKING APPARATUS

[75] Inventors: Junzo Tanaka, Fujiidera; Chikao Urashima, Nara, both of Japan

[73] Assignee: Matsushita Electric Industrial Co., Ltd., Osaka, Japan

[21] Appl. No.: 972,498

[22] Filed: Dec. 22, 1978

Related U.S. Application Data

[63] Continuation of Ser. No. 782,166, Mar. 28, 1977, abandoned.

[30] Foreign Application Priority Data

Mar. 31, 1976 [JP] Japan ..... 51-36428
Sep. 25, 1976 [JP] Japan ..... 51-115303

[51] Int. Cl.[3] ..... H01H 51/08
[52] U.S. Cl. ..... 335/131; 335/126
[58] Field of Search ..... 335/131, 129, 126, 115

[56] References Cited

U.S. PATENT DOCUMENTS

| | | | |
|---|---|---|---|
| 2,514,913 | 7/1950 | Tyrner | 335/131 |
| 2,523,774 | 9/1950 | Moran | 335/129 |
| 3,014,103 | 12/1961 | Moran et al. | 335/129 |
| 3,699,486 | 10/1972 | De Lucia | 335/131 |

FOREIGN PATENT DOCUMENTS

| | | | |
|---|---|---|---|
| 1405231 | 5/1965 | France | 335/129 |

*Primary Examiner*—Harold Broome
*Attorney, Agent, or Firm*—Stevens, Davis, Miller & Mosher

[57] ABSTRACT

A high voltage switch for use in a microwave oven is disclosed which switches a high voltage by an external electric signal. The high voltage switch includes a slider guide chamber of insulative material between a contact making and breaking chamber for switching the high voltage and an electromagnet device to which a low voltage is applied and which serves as a power source for making and breaking the contact, so that the high voltage section is isolated from the low voltage section. An insulative slider extends through the slider guide chamber, and an armature which is directly driven by the electromagnet device and a conducting movable member having a movable contact mounted in the contact making and breaking chamber are linked by the insulative slider. The armature and the conducting movable member are pivotably mounted at their ends so that the drive operation by the electromagnet device is amplified to break the contact. As a result, a small electromagnet device of the A.C. drive type by used resulting in the remarkable improvement of insulation ability, durability and reliability and a simple and compact structure.

12 Claims, 18 Drawing Figures

(a)

(b)

HIGH VOLTAGE SWITCH FOR COOKING APPARATUS

This is a continuation of application Ser. No. 782,166 filed Mar. 28, 1977 now abandoned.

The present invention relates to a high voltage switch for a cooking apparatus such as a microwave oven.

As an approach for switching an output power of the microwave oven, it has been commonly practiced to change a capacitance of a high voltage capacitor in a voltage doubler circuit comprising a high voltage transformer, high voltage capacitor and diode, which voltage doubler supplies a high voltage to a magnetron for generating a microwave. A microwave oven which is capable of having its output power changed is very useful because it allows the setting of a larger number of heating conditions. The ability of changing the output power in the microwave oven has been becoming an essential feature and the importance thereof will increase more and more. In this connection, it is expected that the structure for switching the output power will become complex. As an example, a commercial product has been recently marketed in which two timers for setting heating times are provided which are set simultaneously such that a high output power is produced within the set time of a first timer and when the set time of the first timer has elasped a low output power is produced and at the same time a second timer starts to operate to maintain the low output power during the set time of the second timer. As the structure becomes complex in this manner, a high voltage switch for switching the high voltage is required and an ideal high voltage switch with respect to reliability, cost and construction is particularly necessary.

Because of a requirement for insulation between a low voltage section and a high voltage section and between contacts, a prior art high voltage switch operated by an electric signal, for example, disclosed in U.S. Pat. No. 3,872,277 issued to Nyu, on Mar. 18, 1975, usually includes a so-called reed switch in which contacts are mounted in a completely sealed glass tube and the contacts are made or broken by a magnetic force of a solenoid mounted externally of the glass tube. With this construction, since there exists a relatively large gap between the solenoid and the armature (contact) moved by the magnetic force of the solenoid, the drive force obtained is so weak that it is necessary to apply a D.C. power to the solenoid to enhance a net attraction force. Therefore, an additional component such as a rectifier is required, resulting in an increase in cost. Further, since a glass tube is used, the switch exhibits a weak mechanical strength to impacts and a low reliability. In addition, it is expensive and hard to maintain or repair. Accordingly, a high voltage switch of high reliability, of low cost and of compact construction has been highly desired.

It is an object of the present invention to provide a high voltage switch which is simple in construction, of small size and reliable.

According to the present invention, an insulative slider and a slider guide for guiding and covering the slider are mounted between a contact making and breaking chamber which is a high voltage section and an electromagnet device which is a low voltage section and serves as a power source for making and breaking the contacts, in order to assure insulation between the high voltage section and the low voltage section for remarkably improving insulation ability. At the same time, a large gap existing between the solenoid and the armature in the prior art switch which was directly actuated by the solenoid can be reduced to allow the use of a small electromagnet device operated by A.C. power and the elimination of the rectifier circuit. As a result, the cost can be reduced and the size of the high voltage switch including the small size electromagnet device can also be reduced.

Furthermore, the movement of the armature by the magnetic force at the driving section can be minimized while the movement of the movable contact can be maximized so that the electromagnet device is operated in an efficient manner and compactly constructed while maintaining a required insulation between the contacts.

The above and other objects, features and advantages of the present invention will be apparent from the following description of the preferred embodiments of the invention when taken in conjunction with the accompanying drawings, in which.

Figure 1:
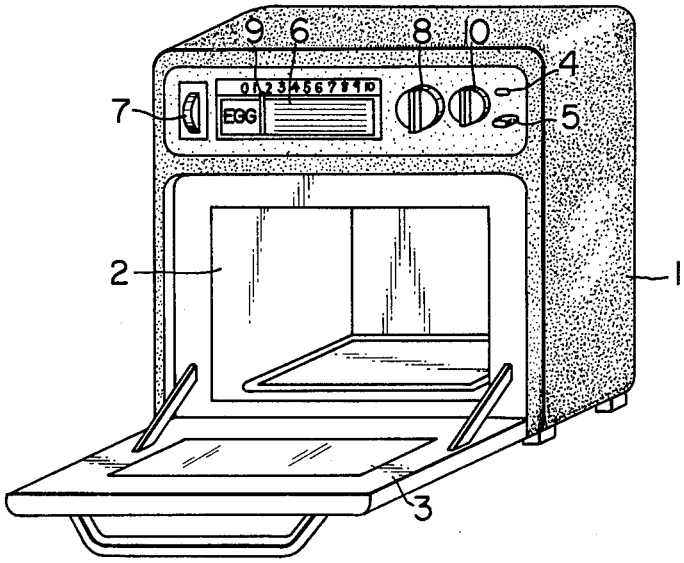
FIG. 1 is a perspective view of a microwave oven incorporating a high voltage switch of the present invention.
Figure 2:
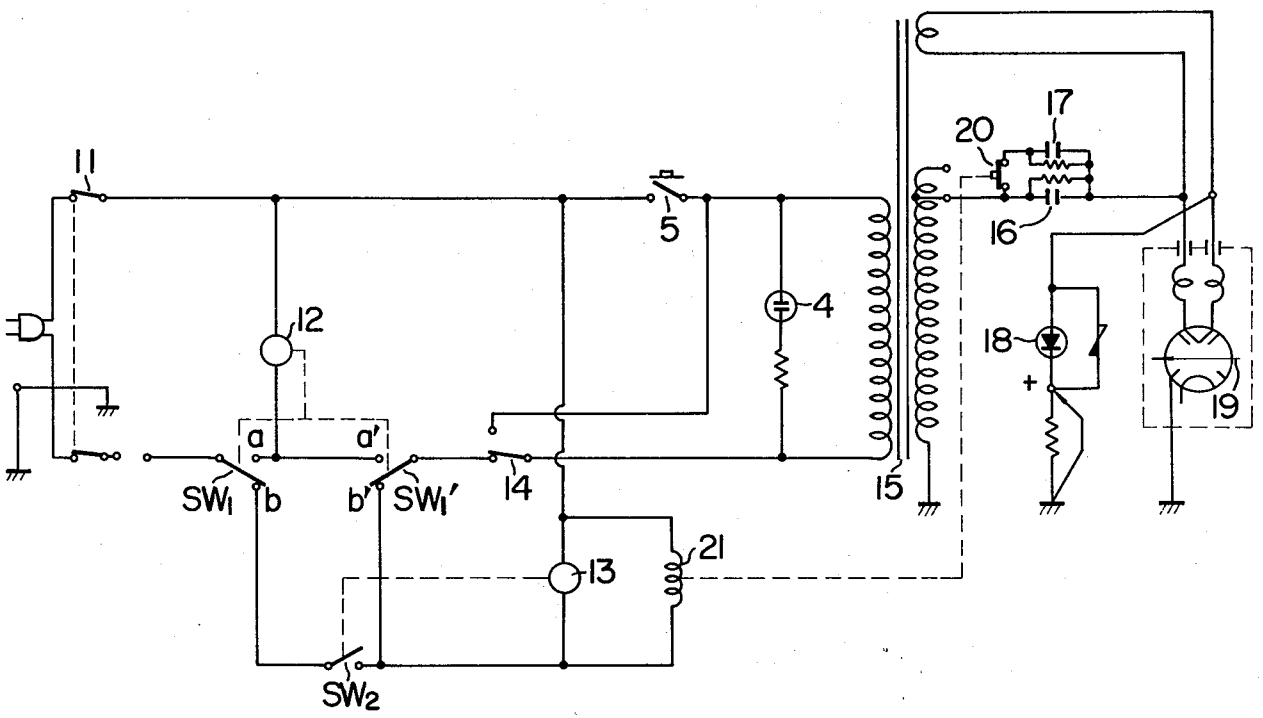
FIG. 2 shows an electric circuit diagram of the microwave oven shown in FIG. 1.
Figure 3:
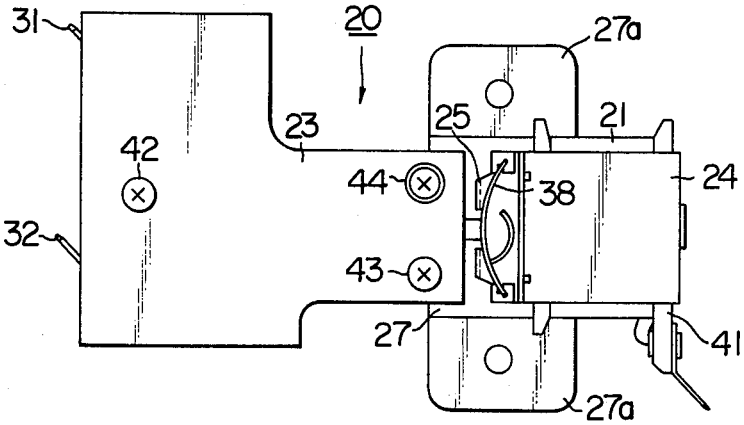
FIG. 3 shows the high voltage switch of the present invention in non-actuated position.

Referring to FIGS. 1 and 2, a high voltage switch of the present switch is now explained as applied to a microwave oven.

The microwave oven uses a microwave energy of the order of 2450 MHz, for example, to cook and heat an article. It has a heating cavity 2 constructed by conductive walls such as stainless steel plate within a main body 1, and a door 3 mounted to the main body 1 to selectively close an opening in a front of the heating cavity. Numeral 4 denotes an indication lamp for indicating when the oven is being operated for cooking, 5 denotes a cooking button, 6 denotes a rotary body on which cooking menu is marked, 7 denotes a control dial for selecting the cooking menu, 8 denotes a first timer which operates as a fifteen minute timer. When the timer 8 is rotated a dial 9 is moved therewith. Numeral 10 denotes a second timer which is operated as a 120 minute timer after the first timer 8 has completed the operation.

Referring to FIG. 2, an electric circuit of the microwave oven is explained. Numeral 11 denotes a safety switch, 12 denotes a motor of the first timer having switches $SW_1$ and $SW_1'$, 13 denotes a motor of the second timer motor having a switch $SW_2$, 14 denotes a door switch, 15 denotes a high voltage transformer, 16 and 17 denote capacitors connected in parallel in a secondary of the high voltage transformer 15, which, together with a diode 18, constitute a voltage doubler-rectifier circuit. Numeral 19 denotes a magnetron, 20 denotes the high voltage switch of the present invention with a solenoid 21 forming a part thereof. The solenoid 21 is connected in parallel with the motor 13 of the second timer and produces a driving force to make or break the contacts.

With the above construction, when the door 3 is shut, the operation times for the first timer 8 and the second timer 10 are set and the cook button 5 is depressed, a voltage is applied to the high voltage transformer 15 because the switches $SW_1$ and $SW_1'$ have been thrown to the positions a and a', and the magnetron 19 starts to oscillate. Since the solenoid 21 is not energized at this time, the switch 20 is in its closed position as shown in FIG. 2 and the capacitors 16 and 17 operate to produce a high voltage.

When the set time of the first timer 8 terminates, the switches $SW_1$ and $SW_1'$ are thrown to the positions b and b' so that the second timer motor 13 is driven and the solenoid 21 is energized to open the switch 20. As a result, only the capacitor 16 operates to produce a low voltage. When the set time of the second timer 10 terminates, the switch $SW_2$ is opened as shown in FIG. 2 so that the application of the power supply to the high voltage transformer 15 is ceased and the oscillation of the magnetron 19 is stopped. The above mechanism of heating for a short time with the high power and then automatically changing to the low power and heating for a long time with the low power is very useful. For example, in a boiling type of cooking such as stew, it is possible to boil a food to be cooked at a constant temperature of about 90° for a long time. On the other hand, in the past, the food to be cooked was initially heated to about 90° C. with the high power and the power was manually changed to the low power and then the food was heated for a long time with the low power, or the food was heated with the low power from the start. In the former case, a troublesome manual switching of the power is necessary, and in the latter case, a long time is required before the food is heated to about 90° C. Accordingly, in the past, the boiling type of cooking has been rarely practiced in a microwave oven. This problem encountered in the prior art microwave oven is overcome by the construction having long and short timers with automatic switching feature. Thus the utility of the microwave oven has been remarkably improved.

The construction and operation of the high voltage switch 20 are now explained in detail with reference to FIGS. 3 to 18.

Figure 18:
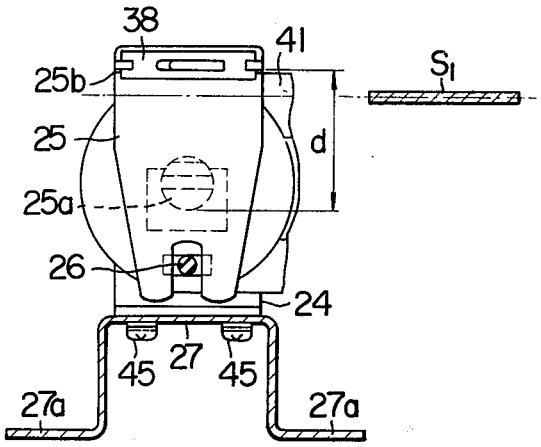
FIG. 18 shows a fragmentary longitudinal sectional view of a movable member of the high voltage switch in the actuated position.

In the drawings, numeral 22 denotes a case made of insulative material, 23 denotes a cover of insulative material for closing the case 22, and 24 denotes a yoke mounted at one end of the case 22, to which yoke the solenoid 21 is mounted. Numeral 25 denotes an armature to be driven by a magnetic force of the solenoid 21, **25*a* denotes an attracted portion. One end of the armature 25 is pivoted at one end of the yoke 24 while the other end of the armature 25 engages one end of the insulative slider 26. Thus, the armature 25 can pivot around the pivot point of the yoke 24 and the movement of the armature 25 is transmitted to the insulative slider 26 with the movement at the attracted portion 25*a* being amplified. As shown in FIG. 18, an effective sectional area of the armature 25 (which relates to a strength of the armature 25 in effecting the pivotal drive) is larger at a region d between the pivot point 25*b* of the armature 25 and the attracted portion 25*a* than in the remaining areas, and a maximum value $S_1$ is set therebetween. A plane A—A—A—A shown in FIG. 4 defines an acting plane of the armature 25, over which the armature 25 operates. The acting plane shows a plane over which the armature moves and the area of the plane is of no importance. During the operation of the armature, a force $F_1$ is applied to the engaging portion of the insulative slider 26**.

Figure 4:
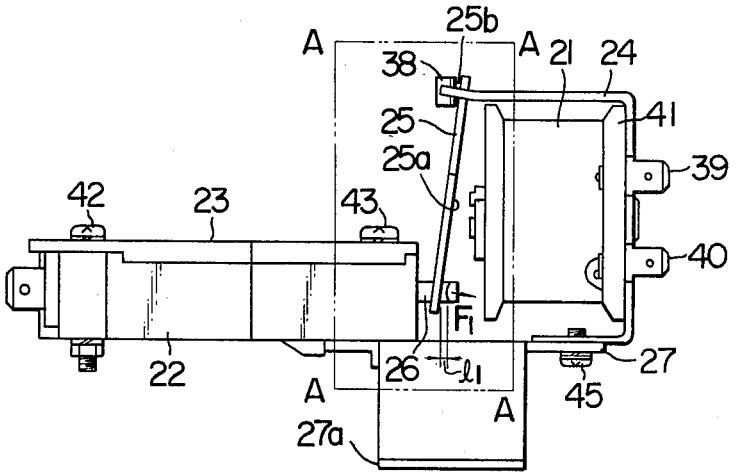
FIG. 4 shows a front view of the high voltage switch shown in FIG. 3.
Figure 5:
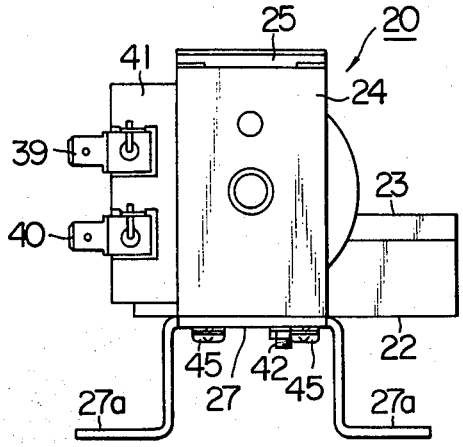
FIG. 5 shows a side view of the high voltage switch shown in FIG. 3.
Figure 6:
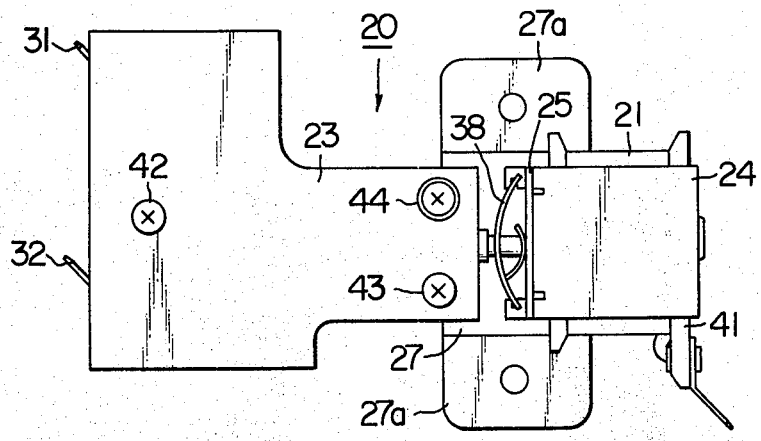
FIG. 6 shows a plan view of the high voltage switch of the present invention in actuated position.
Figure 7:
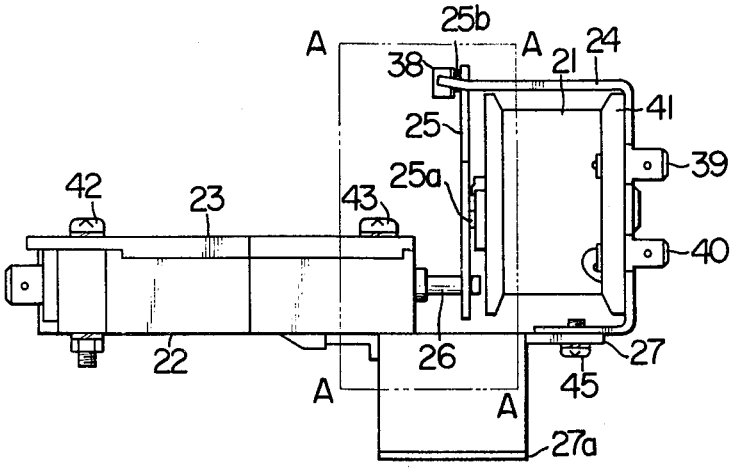
FIG. 7 shows a front view of the high voltage switch shown in FIG. 6.
Figure 8:
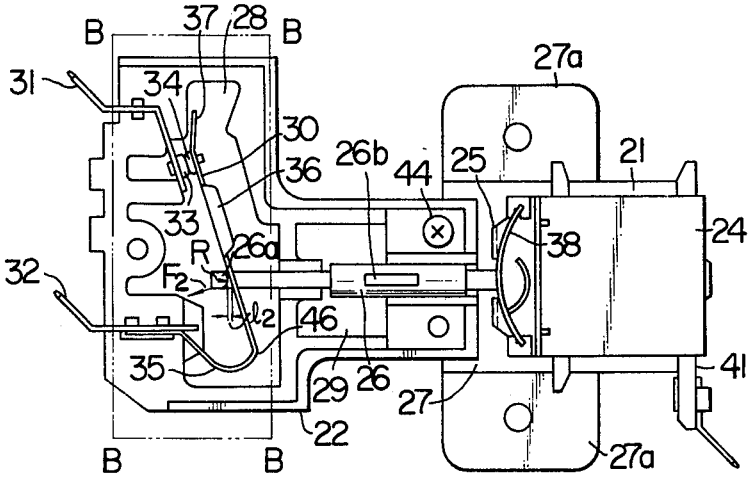
FIG. 8 shows a plan view of the high voltage switch of the present invention in the non-actuated position and with a cover thereof removed.

In FIG. 8, the insulative slider 26 is separated by an insulation distance from the solenoid 21 supported by a solenoid mount 27 and a contact making and breaking chamber 28, and it slidably passes through a slider guide chamber 29 which has dual purpose of dust-proof and guide for the insulative slider 26. The other end of the insulative slider 26 is engaged with a conducting movable member 30 of spring material at the engaging portion **26*a* which is rounded as shown by R in FIG. 8. As shown in FIGS. 4 and 8, a play is established in the nonactuated position between the armature 25 and the conducting movable member 30 by a gap $l_1$ between the armature 25 and the slider 26 and a gap between the conducting movable member 30 and the slider 26, in the direction of the sliding movement of the slider 26, at the engaging portion of the slider 26. Numeral 26*b* denotes a projection for preventing the rotation of the slider 26 which is fitted in grooves of the case 22 and the cover 23. As seen from FIGS. 8 and 10, the sectional area of the insulative slider 26 changes in the direction of the sliding movement and it is maximum at about center of the slider 26. Numeral 27*a* denotes a mounting leg for fixing the high voltage switch 20, and it is made of a metal material and electrically connected through the armature 25 and the yoke 24. Numerals 31 and 32 denote connecting terminals and one end of the connecting terminal 31 in the contact making and breaking chamber 28 has a stationary contact 33 and a corresponding movable contact 34 is provided near a free end 37 of the conducting movable member 30**.

Figure 10:
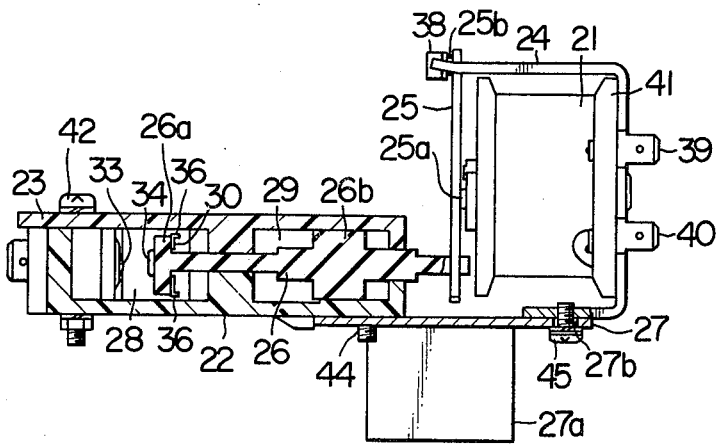
FIG. 10 shows a longitudinal sectional view taken along line X—X in FIG. 9, in the actuated position.
Figure 15:
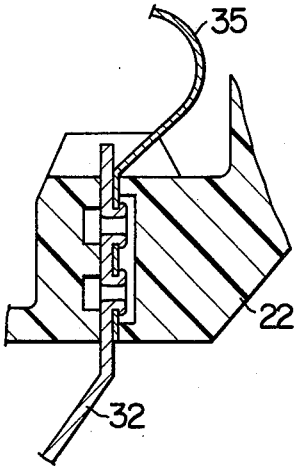
FIG. 15 shows a cross sectional view illustrating a mount of the conducting movable member.
Figure 16:
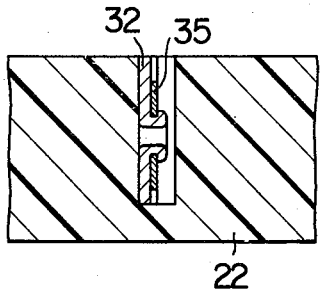
FIG. 16 shows a longitudinal sectional view of the mount of the conducting movable member.
Figure 17:
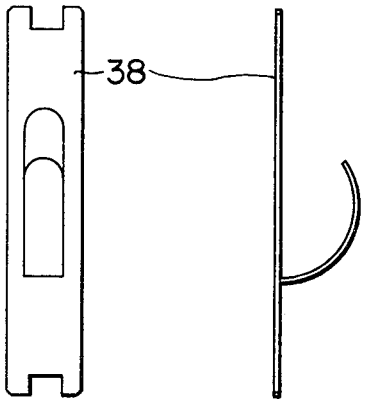
FIG. 17 is an enlarged view of a leaf spring of the high voltage switch.

One end of the connecting terminal 32 is caulked to one end of the conducting movable member 30 as shown in FIGS. 15 and 16 so that it is held together with the conducting movable member 30 with a fitting force being applied to a portion of the case 22 in the direction of the caulk. Numeral 35 denotes a generally U-shaped hinge of spring material integrally formed with the conducting movable member 30. The movable contact 34 is opened or closed through the pivotal movement of the hinge 35. Accordingly, the conducting movable member 30 pivots at the hinge 35 with the movement of the insulative slider 26 being amplified thereby. A plane B—B—B—B shown in FIG. 8 is an acting plane of the conducting movable member 30 over which the conducting movable member 30 operates. During the operation of the member 30, a force $F_2$ is applied to the engaging portion of the insulative slider 26. The design is such that the acting planes A—A—A—A and B—B—B—B are angularly displaced by 90 degrees from each other. The spring force of the hinge 35 imparts a contact pressure of the conducting movable member 30 and a restore force of the armature 25. Numeral 36 denotes a reinforcing flange for the conducting movable member 30 and it is rounded at ends as shown by $R_1$ and $R_2$ in FIG. 13. It is formed by folding a structure shown in FIG. 14 in a developed form along a double chain line intermediate rounded portions $R_3$. Numeral 38 denotes a leaf spring which prevents the rise of a support 9 of the armature 25 when the armature 25 is attracted by the energization of the solenoid 21 to prevent the generation of abnormal noise such as beat, and it is shown in FIG. 17 in a free position prior to mounting to the yoke 24. The gap $l_1$ is shown in FIG. 4 between the insulative slider 26 and the armature 25. This gap is caused not by the armature 25 being expanded by the compression force of the leaf spring 38 but by the fact that the armature 25 is overexpanded to a certain degree by an inertia when the armature 25 is expanded by the spring force of the hinge 35 of the conducting movable member 30 but the armature 25 is supported by the force of the leaf spring 38. Accordingly, when the solenoid 21 attracts the armature 25, the presence of the leaf spring 38 is not a substantial factor to affect the attraction force but rather advantageous for the structure of the high voltage switch 20 of the present invention in which an absolute value of the contact pressure is low, because the contact pressure is not affected by the armature 25. Numerals 39 and 40 denote connecting terminals for the solenoid 21 and the are caulked to a spool 41 formed by the insulative material of the solenoid 21. Numeral 42 denotes a bolt and a nut for fixing the cover 23 to the case 22, numeral 43 denotes a bolt for clamping the case 22 and the cover 23 to the solenoid mount 27, and numeral 44 denotes a bolt for clamping the case 22 to the solenoid mount 27 and it is provided with an escape bore at a portion facing the bolt 44 of the cover 23 so that the bolt 44 does not clamp the cover 23. Numeral 45 denotes a bolt for clamping the solenoid mount 27 to the yoke 24. A bolt aperture **27*b* of the solenoid mount 27 is elongated as shown in FIG. 10 so that the yoke 24 can be moved along the elongated aperture 27*b* to allow the adjustment of positival relation between the armature 25 and the insulative slider 26, in the direction of sliding movement of the insulative slider 26**.

Figure 9:
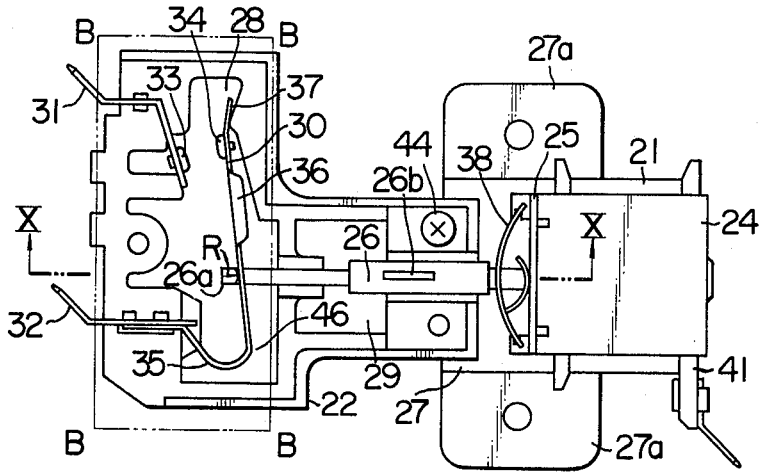
FIG. 9 shows a plan view of the high voltage switch of the present invention in the actuated position with the cover thereof removed.
Figure 11:
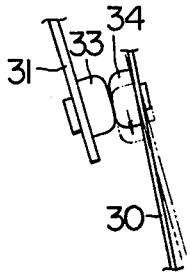
FIG. 11 shows an enlarged view of contacts of the high voltage switch.

With the above construction, when the solenoid 21 is not energized, the contacts 33 and 34 are closed by the spring force of the hinge 35 as shown in FIGS. 3, 4, 5 and 18 and the circuit of FIG. 2 is in the high power state. When the solenoid 21 is energized, the armature 25 is attracted by the magnetic force of the solenoid 21 against the spring force of the hinge 35, and the insulative slider 26 is moved therewith to close the contacts 33 and 34. As a result, the circuit of FIG. 2 assumes the low power state. FIG. 11 shows the movement of the movable contact 34 when it is made or broken. When the contact 34 is broken, it is moved from the solid line position to the double chain line position as the conducting movable member 30 flexes to cause wiping action between the contacts in the direction of an arrow. In FIG. 9, when the contacts 33 and 34 are broken, the free end 37 of the conducting movable member 30 abuts against the case 22, and as the insulative slider 26 is further moved in the direction to separate the contacts 33 and 34, the free end 37 and the hinge 35 is resiliently deformed to absorb the movement. The reinforcing frange 36 arranged to avoid the engaging portion of the insulative slider 26 imparts an appropriate rigidity to the conducting movable member 30 and imparts sensitive and positive switching ability to the contact 34. An extrusion 46 is formed in the hinge 35 for the conducting movable member 30 near the engaging portion of the insulative slider 26, and it is locally hardened by work hardening. Without such locally hardened portion, an elastic deformation would occur between the engagement portion of the non-hardened slider 26 and the hinge 35 (particularly near the extrusion 46). However, since the elastic deformation hardly occurs near the extrusion 46, the entire hinge 35 uniformly deforms. This substantially improves the durability against the break of the spring.

Figure 12:
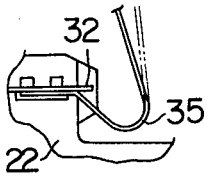
FIG. 12 shows an enlarged view of a hinge portion of a movable member of the high voltage switch in which FIG. 12(*a*) shows a structure of a simple U-shaped hinge portion and FIG. 12(*b*) shows another U-shaped hinge structure having an obtuse-angled extrusion.
Figure 12:
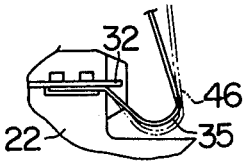

FIG. 12 shows the hinge 35 in its deformed state. It is seen that FIGS. **12*a* and 12*b* show completely different states of deformation of the hinge 35. The solid line shows the state in which the contacts 33 and 34 are not yet broken as shown in FIG. 8, and the double chain line shows the state in which the contacts 33 and 34 have been broken as shown in FIG. 9. In FIG. 12*a* which shows a structure of simple U-shape, most portions of the U-shaped hinge 35 which has been subjected to work hardening do not deform. In FIG. 12*b* which shows a U-shaped structure having the extrusion 46 formed at a portion thereof, the extrusion 46 is more hardened than the other portions of the hinge 35 so that the hinge 35** is more uniformly flexed.

In the present invention, the insulative slider 26 and the slider guide chamber 29 for guiding and covering the slider 26 are arranged between the contact making and breaking chamber 28 which is a high voltage section and the solenoid 21 which is a low voltage section and serves as a power source for making and breaking the contacts, so that the high voltage section is isolated from the low voltage section and the insulation therebetween is assured and the reliability for the insulation ability is enhanced. Furthermore, a large gap between the solenoid and the armature (contacts) driven by the solenoid, which has been necessary in the prior art apparatus where the contacts were directly driven by the solenoid, can be reduced and a stable operation is attained with the small solenoid 21 operated by A.C. power supply. This eliminates the need for a rectifier circuit to supply a D.C. power, reduces the cost and reduces the size of the high voltage switch including the solenoid 21. In connection with the insulation ability described above, since the high voltage section and the low voltage section are physically separated by a given distance, the high voltage section will not touch the low voltage section even if the case 22 should be broken near the high voltage section, and hence a high safety is assured.

Furthermore, since the movement of the armature by the solenoid 21 at the attraction portion **25*a* is amplified by the pivotal movement of the armature 25 and the conducting movable member 30, small movement at the attraction portion 25***a* of the armature 25 by the solenoid 21 can be amplified so that the small solenoid 21 may be used to cause a large amount of displacement of the movable contact 34 required to switch the high voltage. Accordingly, the high voltage switch 23 can be made more compact. Furthermore, since the movement of the armature 25 at the attraction portion 25*a* is small, bounding or chattering of the contacts, that is, the phenomenon in which the armature 25 bounds to break the contacts when the armature 25 is attracted, which phenomenon is extremely disadvantageous to the durability of the contacts and to avoid the fusing of the contact, hardly occurs. This is very advantageous to improve the durability and the reliability of the switch. Moreover, since the movement is amplified not by a single stage but by multiple stages, the movements of the parts in the amplification section are smooth and the wear at the supports is small. This also improves the durability. Since the movement of the armature 25 at the attraction portion 25*a* is small, a large impact noise is not generated when the armature 25 is attracted. This eliminates a noise problem. Since the movement of the armature 25 at the attraction portion 25*a* is small, a fast response of the switch is assured. By effecting the amplification action by the armature 25 and the conducting movable member 30 and using the hinge structure, the construction can be much simplified, the cost can be reduced and the size can also be reduced to make itself adapted to the switch component.

Furthermore, since a play exists between the movement of the contacts and the movement of the armature 25, the contacts 33 and 34 are broken slightly after the armature 25 has started to move by the magnetic force. As a result, even if the contacts 33 and 35 are fused together, a break-off impact force by the inertia of the armature 25 is applied to the contacts 33 and 34 so that the fused contacts are broken off. This considerably enhance the reliability of the switch. Also, even if the misalignment of the positions of the connecting portions, or dimensional errors of the parts exist, they can be absorbed by the play so that the making and breaking action of the contacts 33 and 34 is not affected. Thus, the assembling work and the manufacture of the parts are facilitated and the reliability of the switch in enhanced. Furthermore, since the force for making and breaking the contacts 33 and 34 is required after the slider 26 has started to move, a frictional resistance of the slider 26 at that movement is a dynamic frictional resistance which is substantially smaller than an initial static frictional resistance. Thus, the magnetic force is fully used to make or break the contacts so that the force for making and breaking the contacts is increased and a resistance to fusing is enhanced.

As shown in FIGS. 4 and 8, the acting plane A—A—A—A of the armature 25 is offset by 90 degrees from the acting plane B—B—B—B of the conducting movable member 30. The insulative slider 26 receives forces $F_1$ and $F_2$ including components other than the component in the direction of the sliding movement, from the armature 25 and the conducting movable member 30. Although those forces act to bend or twist the insulative slider 26, they do not act as effective moments because the directions of those forces $F_1$ and $F_2$ are in the acting planes which are offset by 90 degrees. Therefore, the occurrence of oblique wear in the insulative slider 26 and the sliding portion of the case 22 is prevented and hence the durability is improved. When vibration or impact is externally applied, the armature 25 and the conducting movable member 30 may resonate by the affect of the vibration or impact if the acting planes are aligned. In such a case, the contacts 33 and 34 which should be in closed state may be broken or the contacts 33 and 34 which should be in open state may be momentarily made. The present invention overcomes such a problem and provides a structure which does not malfunction readily and is reliable. Since the acting planes are offset by 90 degrees, the swing of the insulative slider 26 by the movement of the conducting movable member 30 and the armature (swing by the respective urging forces) does not cause the misalignment of the engaging positions with the insulative slider 26. That is, even if the insulative slider 26 is urged by the movement of the armature 25 such that the insulative slider 26 is displaced by the distance corresponding to the sliding play to the case 22, this displacement does not occur in the direction which causes the change in the distance between the hinge 35 of the conducting movable member 30 and the engaging portions of the conducting movable member 30 and the insulative slider 26. Similarly, the displacement of the insulative slider 26 by the movement of the conducting movable member 30 does not cause the change in the distance from the support point of the armature 25 to the engaging portions of the armature 25 and the insulative slider 26. Accordingly, the amplification factor of the movement of the conducting movable member 30 to the movement of the armature 25 does not change during the operation so that more stable operation and higher reliability of the switch can be attained.

Since the conducting movable member 30 is made of spring material which is integral with the hinge 35 so that the restoring force of the armature 25 and the contact pressure of the contacts 33 and 34 are imparted by the spring force of the hinge 35, and since the spring is disposed at a position closer to the switching portion of the contacts 33 and 34, higher reliability of the switching of the contacts 33 and 34 is provided. Since the restoring force for the armature 25 and the contact pressure are obtained by single spring, the structure is simple, the cost is inexpensive, the volume is compact and the durability is high. Since no additional resistance such as that by the spring is included, the solenoid 21 of even a small power may be used. For a given force for making and breaking the contacts, smaller solenoid 21 may be used, which reduces the cost. On the other hand, for a given power of the solenoid 21, a greater force for making and breaking the contacts is obtained, which prevents the occurence of fusing of the contacts 33 and 34 and improves the reliability. By forming the conducting movable member 30 with the spring material, rubbing (or wiping) action occurs in the direction transverse to the direction of making and breaking the contacts by the flexure of the spring as shown in FIG. 11, at the time of start of breaking and the end of making of the movable contact 34. This wiping action rubs off an oxide film on the surfaces of the contacts so that the contact resistance between the contacts 33 and 34 is reduced and the conductivity is improved. This overcomes a problem of fusing due to the heat generated between the contacts. Even if the contacts 33 and 34 are fused, a shearing force acts on the fusing because the movable contact 34 moves transversely to the direction of making and breaking the contacts when the movable contact 34 starts to break. Accordingly, the contact 34 is more readily broken than when the force is applied in the direction of making and breaking the contacts. If the contacts 33 and 34 are fused together, the conducting movable member 30 elastically deforms as the armature 25 is attracted by the solenoid 21. As a result, the armature 25 can be moved to a position where it can receive a stronger attracting force from the solenoid 21 and hence to a position where the contacts can receive a stronger attracting force. Thus, a stronger break-off force to the contacts is obtained. This is very effective in preventing contact fusing. Furthermore, since the hinge 35 is integral with the spring, no electrical contact is included therebetween and hence a problem of failure of conduction does not occur. This prevents the damage of parts due to discharge at incomplete contact, particularly of high voltage components, and fire and shock accidents. Since the hinge 35 does not include an engaging portion, undesired frictional resistance is not included and hence the making and breaking of the contacts 33 and 34 can be effected by a smaller force without loss. By forming the conducting movable member 30 with spring material, a contact follow (a distance along which the movable contact, which has moved to make the contact assuming that the stationary contact does not exist, is to move further after it has abutted against the stationary contact) is attained. Therefore, the bounding action when the contacts are made can be absorbed by the contact follow so that more stable switching operation is effected. Thus, the discharge caused by the high voltage during the bounding action is prevented. This is very advantageous in overcoming basic durability problems, such as fusing and wear of the contacts. Furthermore, by constructing the hinge 35 in generally U-shape, the occurrence of a local sharp flex can be prevented, and the hinge is greatly flexed even if the contacts are fused together. Furthermore, by constructing the hinge in generally U-shape, there exists no sharp edge in the curved surface of the hinge 35. As a result, a breakdown voltage in the direction transverse to the curved surface is raised and hence the case 22 can be made more compact. By constructing the hinge 35 with the spring material, the variance in the displacement of the armature 25 can be absorbed. Namely, when the displacement of the armature 25 is too large to cause the insulative slider 26 to pull the conductive movable member 30 beyond the predetermined stroke, the hinge 35 is elastically deformed to absorb the overstroke so that the armature 25 is completely attracted to the solenoid and does not produce beat.

Futhermore, by forming the extrusion 46 at the portion of the generally U-shaped hinge 35, the amount of flexure of the spring member at various points thereof can be readily controlled so that an ideal flexure for the durability of the spring material is attained. In the high voltage switch, since a large contact gap is required, the amount of flexure is large and hence a serious problem for the durability, such as the break of the spring has existed. The present invention solves this problem. Furthermore, since the rigidity of the spring at various points thereof can be controlled by work hardening, no additional part is required and a compact structure is attained. By the positive use of work hardening, a thinner spring material may be used to attain a large rigidity. Accordingly, a more compact structure may be used to attain a higher contact pressure. Where the simple U-shaped structure is used, the spring-back is too large to define the structure after working. By providing the extrusion in addition to the working of the U-shaped structure, the shape can be well defined and the working precision is enhanced. This stabilizes the operating characteristics of the switch (e.g. contact pressure and the direction of the movable contact 34) and enhances the reliability of the switch.

Since the spring property is imparted to the free end 37 of the conducting movable member 30, so that the free end 37 abuts against a portion of the case 22 when the contact 34 is broken to act as a stopper, the vibration which would otherwise occur at the free end 37 of the conducting movable member 30 when the contact 34 is broken is effectively prevented. Thus a fatal problem inherent to the high voltage switch that the contact gap is rendered small enough due to the vibration to cause high voltage arc can be prevented. In the prior art switch, since the high voltage switch requires a large contact gap, a large impact force is applied to the stopper when the contacts 33 and 34 are broken, and hence the caulk of the movable contact 34 is apt to be loosened and the movable contact 34 may eventually drop off. According to the present invention, since the impact force is absorbed by the spring action of the free end 37 of the conducting movable member 30, the contacts are made and broken in a very smooth manner. This is very advantageous in improving switch durability and reliability. When the movable contact 34 is broken due to the variation in the travel distance of the armature 25 and the insulative slider 26, if the insulative slider 26 moves in the direction to break the movable contact 34 even after the free end 37 of the conducting movable member 30 has abutted against the case 22, the free end 37 also elastically deforms to absorb the movement. As a result, a stress applied to the hinge 35 is reduced to about half to prevent breakage of hinge 35. This considerably enhances durability. The force of the solenoid 21 to attract the armature 25 is minimum when the contacts 33 and 34 start to break and maximum when they have been broken. The force of the spring to restore the armature 25 is also maximum when the contacts have been broken. The rate of change for the force of the solenoid 21 is much higher than that for the force of the spring. Therefore, if the operating voltage is reduced, the restoring force is also considerably reduced and in an extreme case restoring of the switch is delayed or does not occur. Accordingly, in the prior art switch, it is not possible to reduce the operating voltage although it has been known to be very advantageous to do so to increase a separation force of the contacts and prevent the fusing of the contacts. According to the present invention, since the free end 37 of the conducting movable member 30 makes spring contact with the case 22, the separation of the armature 25 from the solenoid 21 is enhanced. As a result, it is possible to reduce the operating voltage. This is very advantageous in preventing contact fusing.

The conducting movable member 30 is formed with the reinforcing flange 36 except at the engaging portion. When the conducting movable member 30 is integrally formed by the hinge 35 and the spring material, the material of the spring may be selected to match the spring property of the hinge 35. Moreover, the high voltage switch 20 has a large contact gap. Accordingly, the swing of the conducting movable member 30 near the free end 37 thereof due to the spring action thereof is apt to be excessive. According to the present invention, this problem is resolved by imparting appropriate rigidity to the conducting movable member 30. The suppression of the excessive swing of the conducting movable member 30 due to the spring action also prevents the breakage of the spring and a high voltage discharge which occurs when the contact gap is too small by the excessive swing of the movable contact 34. This considerably improves the durability. When the free end 37 of the conducting movable member 30 abuts against the portion of the case 22 and it is further deformed, it is elastically deformed also near the engaging portion to the insulative slider 26. As a result, no excessive force is applied to the hinge 35 and a problem of the breakage of the hinge 35 is avoided. Since the excessive flexure does not occur in the conducting movable member 30, higher contact pressure may be established. This assures more positive closure of the contacts 33 and 34 and the fusing of the contacts 33 and 34 due to the discharge caused by incomplete contact is prevented. In addition, since the problem of excessively small contact gap by the overswing of the movable contact 34 hardly occurs, the contact gap may be set to a minimum and hence the case 22 can be constructed in more compact structure.

Figure 13:
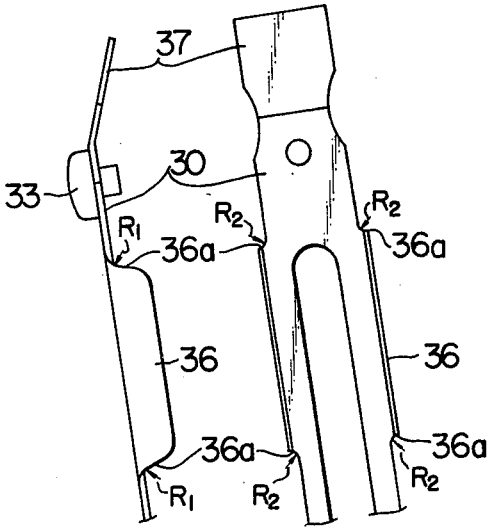
FIG. 13 shows an enlarged view of a conducting movable member of the high voltage switch.
Figure 14:
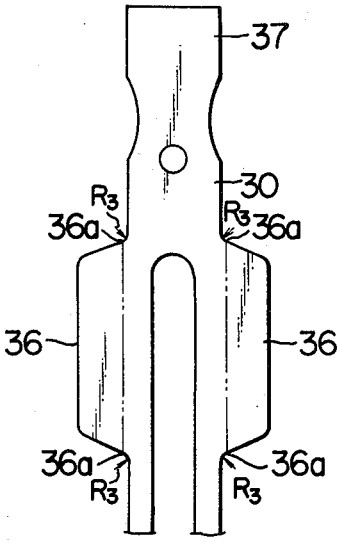
FIG. 14 shows a developed view of the conducting movable member of FIG. 13.

By forming the rounded portions $R_1$ and $R_2$ at the ends of the reinforcing flange 36 for the conducting movable member 30 as shown in FIG. 13, the concentration of the stress to the end 36*a* which delimits the reinforcing section and the non-reinforcing section is prevented. This, in turn, prevents the breakage of the conducting movable member 30 and considerably improves the durability. Since the rounded portions $R_1$ and $R_2$ are formed from the common rounded portions $R_3$ as shown in the developed view of FIG. 14, smooth continuity is attained between the rounded portions $R_1$ and $R_2$. This is also effective in preventing the concentration of stress. Furthermore, since the reinforcing flange 36 is formed by folding the structure of FIG. 14 intermediate the rounded portion $R_3$, the effect of preventing the concentration of stress is not affected even if the folding position is slightly displaced provided that it is within the rounded portion $R_3$ . This facilitates switch construction.

As shown in FIGS. 15 and 16, since the caulked conducting movable member 30 and the high voltage connecting terminal 32 are fitted to and held by the portion of the contact making and breaking chamber 28 such that they reinforce the caulk, no backlash will occur in the direction of the caulk even if the caulking area is very small because of improper caulking. Thus, the coupling of the conducting movable member 30 and the connecting terminal 32 is not broken and the reliability of coupling is considerably enhanced. Since the high voltage switch 20 has the large contact gap due to breakdown voltage requirements, the movement of the conducting movable member 30 is large and hence it has been very difficult to support the end support of the conducting movable member 30, i.e. the coupling between the conducting movable member 30 and the connecting terminal 32. According to the present invention, the coupling can be very strongly supported.

Furthermore, since the support 25*b* of the armature 25 is compressively held by the leaf spring 38, the lifting of the armature 25 is effectively prevented by the small force of the leaf spring 38 so that the occurrence of abnormal noise such as beat which would otherwise be inherent to the solenoid 21 can be prevented. Even if the force of the leaf spring 38 is slightly larger, it is converted to a very small force at the engaging portion of the armature 25 with the insulative slider 26 and the attraction portion of the solenoid 21 because of the length of the arm so that the affect of the leaf spring 38 on the operating voltage of the high voltage switch 20 and the movement of the insulative slider 26 can be substantially neglected. Since the high voltage switch 20 requires a large contact gap the operating voltage would necessarily be high. In the present invention, by minimizing the affect of the armature 25, the tolerance of the operating voltage becomes larger. This is advantageous to prevent the fusing of the contacts. Since the support 25*b* of the armature 25 is directly held in compression, the structure is compact. Particularly in the high voltage switch 20, it is not preferable from the standpoint of insulation that the metal member such as the spring material extends outwardly to a large extent. Accordingly, the compact structure described above is particularly advantageous.

Furthermore, as illustrated in FIG. 18, which shows the effective cross section of the armature from the support 25*b* to the engaging portion thereof with the insulative slider 26 (i.e. the cross section related to the strength of the armature is effecting the support drive), the cross sectional area of the length d from the support 25*b* to the attraction portion 25*a* attracted by the magnetic force of the solenoid 21 is designed to be larger than the sectional area in the other portion and is limited to a minimum required value $S_1$. Accordingly, the reluctance of the armature 25 can be minimized and the attracting force of the solenoid to the armature 25 can be maximized while making the sectional area of other portion smaller. As a result, the weight of the armature 25 is reduced and the response of the switch is improved and the size of the solenoid 21 is reduced. Because of the nature of the high voltage switch 20, namely, that it switches a high voltage, arc generation time during the switching of the contacts 33 and 34 is long. This would be very disadvantageous in improving the durability of the contacts and preventing their fusing. According to the present invention, since the weight of the armature 25 is reduced to speed up the making and breaking speed of the movable contact 34, the above disadvantages are eliminated. Furthermore, by reducing the weight of the armature 25 while maintaining the maximum attraction force of the solenoid 21 to the armature 25, the affect by the external vibrations and shocks can be eliminated and a more stable operation of the high voltage switch 20 is attained. For example, when the high voltage switch 20 is used in a microwave oven, since the door 3 of the microwave oven is of relatively large size and is frequently opened and closed, a considerable degree of vibration and shock is applied to the high voltage switch 20 during the opening and closing operation of the door 3. This would pose a severe condition on the durability of the high voltage switch 20, but are effectively dealt with by the reduction in weight of the armature. The structure of the present invention makes itself adaptable to the use in the microwave oven. The reduction of the weight of the armature 25 also reduces the impact caused when the armature 25 is attracted to the solenoid 21, and suppresses the unstable operation and operation noise which would otherwise be caused by the impact. This enhances the reliability and the commercial value of the solenoid as a switch component.

Furthermore, as shown in FIG. 10, since the positional relation of the armature 25 and the ininsulative slider 26 can be adjusted in the direction of the sliding movement of the insulative slider 26 by the elongated bolt aperture 27*b* of the solenoid mount 27, an optimum operating condition of making and breaking the contacts can be established. Particularly in the high voltage switch 20, since the large contact gap is required, the solenoid 21 must be very large unless the operating condition is closely controlled. In addition, since the large contact gap is required, the movement of the contact 34 is given by amplifying the movement of the attraction portion 25*a* of the armature 25 by the solenoid 21 in order to efficiently make and break the contacts 33 and 34. In this case, the condition of making and breaking the contacts 33 and 34 changes considerably with a slight positional displacement between the armature 25 and the insulative slider 26. Accordingly, it is very significant that the positional relation of the armature 25 and the insulative slider 26 is adjustable. Furthermore, since the movement of the movable contact 34 can be adjusted without changing the relations between the insulative slider 26 and the conducting movable member 30 and between the armature 25 and the solenoid 21, the adjustment of the movement of the movable contact 34 is easily made without misadjustment. This enhances the reliability of the switch. Where the conducting movable member 30 is formed by folding the spring material, the precision of working is not high and hence a considerable amount of variation must be included in the direction of making and breaking the movable contact 34. In addition, where the insulative slider 26 is molded from a resin material, dimensional errors due to variations in molding conditions and strain are included. According to the present invention, those errors can be readily absorbed by the single adjustment. In the high voltage switch 20, as described above, since the large contact gap is required, the free end 37 of the conducting movable member 30 normally abuts against the case 22 with a large impact force when the contacts 33 and 34 are broken. If the stroke of the insulative slider 26 after the free end 37 has abutted against the case 22 is too large, the impact force applied to the free end 37 and the bending force applied to the conducting movable member 30 become excessive so that the deformation of the conducting movable member 30, the breakage of the spring material or the drop-off of the contact due to loosening of the caulk of the contact may occur. Furthermore, a critical problem may occur where the solenoid 21 cannot fully attract the armature 25. Conversely, where the stroke of the insulative slider 26 is too small, the free end 37 of the conducting movable member 30 is away from the case 22 even after the contacts 33 and 34 have been separated. In this case, the free end 37 of the conducting movable member 30 and the movable contact 34 swing to a large extent so that the contact gap temporarily becomes extremely small to cause discharge by the high voltage. This, in turn, causes the melting or fusing of the contacts and also leads to the damage of the case 22. The above problems are resolved by the construction of the present invention. By providing a play between the movement of the movable contact 34 and the armature 25 such that the contacts 33 and 34 are broken slightly after the armature 25 has started to be moved by the electromagnetic force, the impact break-off force due to the inertia of the armature is applied to the contacts 33 and 34 so that the fusing of the contacts 33 and 34, even if it is present to a greater or less extend, can be broken off as described above. However, if the play is too much, the movement of the armature 25 becomes larger making it difficult to attract the armature 25 by the solenoid 21. Therefore, the play must be of proper amount. According to the construction of the present invention, the play can be optimally established.

Furthermore, since the sectional area of the insulative slider 26 is changed along the direction of the sliding movement such that it is maximum near the center, the weight of the insulative slider 26 can be reduced while suppressing the occurrence of strain in the insulative slider 26. If a larger insulative slider 26 is used, the response of the switch is delayed and the sliding resistance also increases requiring a larger solenoid 21. Accordingly, it is desirable that the insulative slider 26 is designed to be as compact as possible. However, if the entire insulative slider 26 is uniformly made slim, a strain is apt to occur in the insulative slider 26, made by molding a resin material. This materially interferes with the sliding operation, and in an extreme case, the sliding operation does not occur. According to the present invention, since the sectional area of the center area where the strain is apt to occur is larger than that of other areas, the occurrence of the strain during molding and the use at an elevated temperature is suppressed and the weight can be reduced. Even if the strain occurs, it occurs only at the ends of the insulative slider 26 and such strain has a much reduced affect on the sliding movement than strain occurring at the center. Because the high voltage switch 20 switches a high voltage, the arc generating time in making and breaking the contacts 33 and 34 is long. This has posed a problem in preventing the fusing of the contacts 33 and 34 and improving the durability thereof. According to the present invention, since the weight of the insulative slider 26 is effectively reduced to allow the speed-up of the switching time of the movable contact 34, the above problem is substantially eliminated. Furthermore, by reducing the weight of the insulative slider 26, the high voltage switch 20 can be made more compact and the vibration of the conducting movable member 30 which would otherwise be caused by the overswing of the insulative slider 26 by inertia when the contacts 33 and 34 are broken and by the rebounce can be suppressed. As a result, the generation of the arc due to the unstable closure of the contacts 33 and 34 can be prevented.

Furthermore, as shown in FIG. 8, since the engaging portion 26*a* of the insulative slider 26 with the conducting movable member 30 is rounded, the abutment of the engaging portion 26*a* to the conducting movable member 30 occurs in a line contact fashion and the abutment position of the engaging portion 26*a* smoothly moves as the conducting movable member 30 makes or breaks contact; thus, the switching of the high voltage can be effected in a very stable manner. This is advantageous in improving the reliability and the durability of the high voltage switch 20. In the high voltage switch 20, since the contact gap should be large because of the high breakdown voltage, the movement of the insulative slider 26 is amplified. As a result, a slight movement between the conducting movable member 30 and the engaging portion 26*a* of the insulative slider 26 appears amplified between the contacts. Accordingly, the smooth movement between the engaging portion 26*a* of the insulative slider 26 and the conducting movable member 30 is particularly significant. The conducting movable member 30 is formed by bending. Since it is relatively difficult to attain high dimensional precision by bending, the conducting movable member 30 is usually dimensionally unstable in the direction of the making and breaking of the contacts. According to the construction of the present invention, even if the abutment angle of the conducting movable member 30 with respect to the engaging portion 26*a* of the insulative slider 26 changes, more or less, the abutment action is little affected thereby and the conducting movable member 30 can be switched in a satisfactory manner. Furthermore, in the high voltage switch which switches the high voltage, a strong arc is generated, which deteriorates the insulative material such as resin material. When the insulative material is of small volume or includes an edge portion, the affect is particularly large and in the worst case the insulative material such as resin material is destroyed. According to the construction of the present invention, since the engaging portion 26*a* of the insulative slider 26 is rounded, the resistance to arc at the engaging portion 26*a* is enhanced so that the durability of the high voltage switch 20 is improved.

Furthermore, by disposing the movable member 25 between the slider guide chamber 29 and the solenoid 21 and electrically connecting the fixing mount 27*a* of the high voltage switch 20 and the armature 25 through the yoke 24, the touch of the high voltage to the low voltage section is prevented. Namely, in FIG. 12, if the high voltage section of the high voltage switch 20 should be grounded, the secondary winding of the high voltage transformer 15 is short-circuited but it does not lead to an accident such as electric shock. On the other hand, if the high voltage section touches the low voltage section, that is, the solenoid 21, the high voltage would be applied to the low voltage section, leading to a very dangerous electric shock accident. According to the construction of the present invention, since the low voltage section is surrounded by the armature 25 and the yoke 24 which is electrically connected to the fixing mount 27*a* of the high voltage switch 20 and the fixing mount 27*a* is grounded, when the high voltage at the contacts 33 and 34 is going to be applied to the solenoid 21, it is instantly grounded from the fixing mount 27*a* through the armature 25 and the yoke 24 surrounding the solenoid 21. Thus, the accident can be prevented and the high voltage switch operates in a safe manner. In addition, by disposing the armature 25 between the low voltage section and the high voltage section, the touch of the high voltage to the low voltage section is prevented with a high reliability.

Furthermore, since the connecting terminals 39 and 40 of the solenoid 21 are caulked to the spool 41 of the solenoid 21, the high voltage connecting terminals 31 and 32 can be clearly distinguished from the low voltage connecting terminals 39 and 40 so that the misconnection of the high voltage section and the low voltage section can be prevented. This assures a safeguard to a service man when he connects or disconnects the connecting terminals 39 and 40 of the solenoid 21 in the low voltage section while the high voltage is being applied. Furthermore, since the high voltage section and the low voltage section are physically separated as respective units, the touch between the high voltage section and the low voltage section is prevented.

What is claimed is:

1. A high voltage switch comprising:

a contact making and breaking chamber made of insulative material for accommodating a conducting movable member carrying a movable contact for switching a high voltage and a stationary contact member carrying a stationary contact, said conducting movable member being made of a resilient material having at one end a U-shaped hinge portion and having at the other end said movable contact, said one end of said conducting movable member having the U-shaped portion being fixed to a wall of said contact making and breaking chamber thereby to maintain normally closed said movable and said stationary contacts by a resilient force exerted by the U-shaped hinge portion;

an electromagnet device having a movable aramture pivotably supported at one end thereof by a yoke;

an elongated slider made of insulative material and having one end coupled to a free end of said movable armature and having the other end coupled to said conducting movable member for transmitting a driving force of said electromagnetic device to said conducting movable member;

a slider guide chamber made of insulative material for guiding said elongated insulative slider and for insulatively isolating said contact making and breaking chamber from said electromagnetic device, said slider guide chamber having apertures formed in opposite walls for slidably guiding therethrough said elongated insulative slider and for enclosing substantially the entire length of said elongated insulative slider in a dust-proof manner.

2. A high voltage switch comprising:

a contact making and breaking chamber made of insulative material for accommodating a conducting movable member carrying a movable contact for switching a high voltage and a stationary contact member carrying a stationary contact, said conducting movable member being made of a resilient material and having one end fixed to a wall of said contact making and breaking chamber and having at the other end said movable contact thereby to maintain normally closed said movable and said stationary contacts by a resilient force exerted by the resilient material;

an electromagnetic device having a movable armature pivotably supported at one end thereof;

an elongated slider made of insulative material and having one end coupled to a free end of said movable armature and having the other end coupled to said conducting movable member for transmitting a driving force of said electromagnetic device to said conducting movable member;

a slider guide chamber made of insulative material for guiding said elongated insulative slider and for insulatively isolating said contact making and breaking chamber for said electromagnetic device, said slider guide chamber having apertures formed in opposite walls for slidably guiding therethrough said elongated insulative slider and for enclosing substantially the entire length of said elongated insulative slider in a dust-proof manner.

3. A high voltage switch according to claim 2 further including an amplifying transmitting means disposed at at least one end of said insulative slider.

4. A high voltage switch according to claim 3 wherein said amplifying transmitting means comprises an armature of said electromagnet device coupled to said slider and said conductive movable member, at least one of which is pivotable by a cantilever structure.

5. A high voltage switch according to claim 4 wherein at least one of the couplings between said insulative slider and said armature and between said insulative slider and said conducting movable member is provided with a clearance such that there exists a play in the direction of sliding movement of said insulative slider.

6. A high voltage switch according to claim 2 wherein an acting plane of said armature of said electromagnet device and an acting plane of said conducting movable member are offset by approximately 90 degrees.

7. A high voltage switch according to claim 2 wherein said conducting movable member is made of spring material so that an elastic force thereof functions to impart a contact pressure as well as a restoring force for the armature of said electromagnet device.

8. A high voltage switch according to claim 1 wherein said U-shaped hinge structure is formed with an extrusion at a portion thereof, said extrusion having been subjected to work hardening to allow adjustment of the amount of flexure at various points of the hinge structure.

9. A high voltage switch according to claim 2 wherein said conducting movable member is pivoted by said insulative slider to make and break the contact, and when the movable contact is to be broken a free end of said conducting movable member is abutted against a wall of said contact making and breaking chamber to restrict the movement of said conducting movable member.

10. A high voltage switch according to claim 2 wherein an armature of said electromagnet device comprises a cantilever structure, and a sectional area between a support point of said armature and an electromagnetically attracted portion thereof is larger than a sectional area of remaining portion between said support point of said armature and an engaging point thereof with said insulative slider.

11. A high voltage switch according to claim 4 wherein said armature of said electromagnet device is adjustable in positional relation to said insulative slider in the direction of sliding movement of said insulative slider.

12. A high voltage switch comprising:

a contact making and breaking chamber made of insulative material for accommodating a conducting movable member carrying a movable contact for switching a high voltage and a stationary contact member carrying a stationary contact;

an electromagnetic device having a movable armature;

an elongated slider made of insulative material and having one end coupled to said movable armature and having the other end coupled to said conducting movable member for transmitting a driving force of said electromagnetic device to said conducting movable member;

a slider guide chamber made of insulative material for guiding said elongated insulative slider and for insulatively isolating said contact making and breaking chamber from said electromagnetic device, said slider guide chamber having opposite end walls each having an aperture therein for slidably guiding therethrough a corresponding end of said elongated insulative slider and enclosing substantially the entire length of said elongated insulative slider between said end walls in a dust-proof manner to prevent entrance of dust from said contact making and breaking chamber and from an area containing said electromagnetic device into said slider guide chamber.

* * * * *